US010214386B2

(12) United States Patent
Hall et al.

(10) Patent No.: US 10,214,386 B2
(45) Date of Patent: Feb. 26, 2019

(54) RACK AND CHAIN DRIVEN ELEVATOR

(71) Applicants: David R. Hall, Provo, UT (US); Jackson Priddis, Orem, UT (US); Andrew Priddis, Mapleton, UT (US); Eimi Priddis, Mapleton, UT (US)

(72) Inventors: David R. Hall, Provo, UT (US); Jackson Priddis, Orem, UT (US); Andrew Priddis, Mapleton, UT (US); Eimi Priddis, Mapleton, UT (US)

(73) Assignee: Hall Labs LLC, Provo, UT (US)

( * ) Notice: Subject to any disclaimer, the term of this patent is extended or adjusted under 35 U.S.C. 154(b) by 249 days.

(21) Appl. No.: 15/194,938

(22) Filed: Jun. 28, 2016

(65) Prior Publication Data

US 2017/0369283 A1 Dec. 28, 2017

(51) Int. Cl.

| | |
|---|---|
| ***B66B 9/02*** | (2006.01) |
| ***B66B 13/30*** | (2006.01) |
| ***B66B 5/16*** | (2006.01) |

(52) U.S. Cl.

CPC ..... *B66B 9/022* (2013.01); *B66B 5/16* (2013.01); *B66B 13/303* (2013.01)

(58) Field of Classification Search

CPC ..... B66B 9/022; B66B 5/16; B66B 11/0461; B66B 13/303

See application file for complete search history.

(56) References Cited

U.S. PATENT DOCUMENTS 651,236 A * 6/1900 Corcoran ..... B66B 11/0469 187/250
828,029 A * 8/1906 Jackson ..... B66B 9/022 187/271
966,231 A * 8/1910 Newson ..... B66B 9/022 187/271
1,140,319 A * 5/1915 Van Houten ..... F16H 7/06 305/202
1,634,854 A * 7/1927 Scollard ..... B66B 9/022 187/270
1,902,946 A * 3/1933 Breed ..... B66B 9/10 187/270
3,313,376 A * 4/1967 Holland, Sr. ..... B66B 9/022 182/129
3,399,578 A * 9/1968 Lindabury, Sr. ..... F16H 7/06 254/95
3,824,871 A * 7/1974 Loesch ..... F16H 19/04 74/37
3,946,836 A * 3/1976 Maack ..... B66B 9/02 104/288
4,433,752 A * 2/1984 Gunter ..... B66B 9/022 182/142

(Continued)

*Primary Examiner* — Michael A Riegelman

(57) ABSTRACT

The invention is an elevator. The elevator is driven by a rack and a chain. The elevator also comprises a transportable frame, a floor, and an elevator shaft. The purpose of the invention is, by using a rack and chain lifting device to drive the elevator, to allow the elevator to be driven from the bottom. Driving the elevator from the bottom makes the structural integrity of the elevator box unnecessary, so that the elevator box can be replaced with an elevator box façade and a fabric door, making the elevator lighter and more economical. In addition, the design of the elevator allows for adjacent doors, battery power, and voice control.

19 Claims, 19 Drawing Sheets

(56) References Cited

U.S. PATENT DOCUMENTS 4,753,119 A * 6/1988 Kuspert ..... F16H 19/06 74/422
5,191,920 A * 3/1993 McGregor ..... B65B 43/59 141/114
5,452,774 A * 9/1995 Davis ..... B66B 9/16 187/270
5,558,181 A * 9/1996 Bundo ..... B66B 9/022 187/270
5,566,783 A * 10/1996 Yamashita ..... B66B 11/009 187/210
5,819,584 A * 10/1998 Evans ..... F16H 19/06 74/89.21
5,967,926 A * 10/1999 Kozakura ..... F16H 7/06 474/206
5,989,140 A * 11/1999 Ichikawa ..... F16H 7/06 474/148
6,155,944 A * 12/2000 Matsuda ..... F16G 13/04 474/157
6,361,131 B1 * 3/2002 Powell, Jr. ..... A47B 46/00 187/254
6,440,022 B1 * 8/2002 Ichikawa ..... F16G 13/04 474/161
7,311,179 B1 * 12/2007 Franklin ..... B66B 11/005 187/270
8,863,907 B2 * 10/2014 Studer ..... B66B 9/022 187/270
9,085,367 B2 * 7/2015 Steinbeck ..... B64D 11/0696
2007/0034453 A1 * 2/2007 Kim ..... B66B 9/00 187/391
2008/0190706 A1 * 8/2008 Franklin ..... B66B 9/027 187/251
2010/0119338 A1 * 5/2010 Webster ..... E04H 6/18 414/239
2011/0183799 A1 * 7/2011 Young ..... F16G 13/04 474/148
2013/0228289 A1 * 9/2013 Klish ..... E06B 9/82 160/7
2014/0124293 A1 * 5/2014 Eversole ..... B66B 9/022 182/103
2016/0075533 A1 * 3/2016 Scomparin ..... B66B 9/003 187/240
2017/0350472 A1 * 12/2017 Hall ..... F16G 13/04
2017/0355578 A1 * 12/2017 Hall ..... B66F 3/02
2017/0363186 A1 * 12/2017 Hall ..... B66B 11/0045
2018/0050887 A1 * 2/2018 Hall ..... B66B 13/303

* cited by examiner

RACK AND CHAIN DRIVEN ELEVATOR

TECHNICAL FIELD

This invention relates generally to the field of elevators, and more specifically to rack and chain driven elevators.

BACKGROUND

The lifting capacity of an average person amounts to a few hundred pounds. For this reason, people have turned for centuries to mechanical means of lifting heavy items. Some of the means devised include pulley systems, cranes, scissor lifts, or linear actuators. One type of linear actuator of particular interest here is a rack and pinion device.

Elevators generally utilize a pulley-type system. Usually, a cable is attached to the top of an elevator box, and a counterweight is attached to the free end of the cable. The elevator box moves up and down within an elevator shaft when the cable is engaged by a motor. Safety devices are in place in the event that the cable breaks.

Though this basic system has been used for decades, there are disadvantages inherent in the pulley system method for lifting an elevator. First, the distance that an elevator can travel is limited by the length of the cable. Second, and even more importantly, the method does not maximize efficiency or cost of materials, which is desirable in the construction of green and sustainable buildings. When an elevator is lifted from the top by means of a cable, the elevator box plays an important structural role in the lifting. The box must be built for strength and stability, so that the elevator box floor is securely attached to the elevator box ceiling, where the cable is attached. On the other hand, if an elevator box were lifted from the bottom, the structure of the elevator box would be insignificant. Lighter and cheaper materials could be used to form the elevator box because the top portion of the box would not need to bear weight. In turn, the motor would not require as much power to lift the elevator if the elevator box were created from lighter materials. The machine room where the motor is stored in the case of traditional elevators could be eliminated. Furthermore, an additional structure extending the elevator shaft above the rooftop to allow access to the roof would be unnecessary. Therefore, a better elevator design would incorporate lifting from the bottom using other mechanical means.

One device that could conceptually be used for lifting an elevator from the bottom is a rack and pinion device. Rack and pinion devices are configured to convert rotational motion to linear motion. They are often used for creating horizontal linear motion, such as in transport, packaging, and assembly machines, but rack and pinion devices are also used for vertical linear motion. However, when lifting heavy items vertically, rack and pinion devices have some disadvantages. First, rack and pinion devices normally have only a few points of contact between the rack and the pinion. If a rack and a pinion have contact at only a few points, those points of contact may be put under disproportionate amounts of stress when lifting, which could cause the rack and pinion device to fail. Because reliability or safety are chief concerns in creating an elevator, taking chances with parts that might break under load could lead to disastrous results. This problem is sometimes solved by increasing the size and, therefore, the load capacity of the rack and pinion, but larger parts are harder to manufacture, require more space, and cost more. A larger rack and pinion also might require a larger motor, which further leads to decreased efficiency.

One other issue with rack and pinion devices is that these devices generally are not placed in corners. That is because the motor extending out from the pinion is generally too large to fit in the space available within the angle of the corner. This limits the versatility of the devices. In an elevator shaft, because rack and pinion devices cannot be placed in corners, they would necessarily be placed along the sides, which would limit the potential space available for access to the elevator. Furthermore, it would prevent use of the rack as part of the structure of the elevator shaft.

In light of the foregoing, what is needed is an elevator driven by a rack and chain device. A rack and chain device would allow the elevator to be lifted from the bottom, as with a rack and pinion device. However, replacing a pinion with a silent chain would allow the points of contact with the rack to be increased, taking pressure off of each individual tooth. A silent chain would also allow the motor to be distanced from the rack, so that the device could be placed in corners. However, because the profile of a typical silent chain is built to conform only to the profile of a sprocket, not a rack, a silent chain with a profile that would allow it to configure to both a sprocket and a rack, and racks and sprockets configured to engage with the silent chain, would be needed as well.

SUMMARY OF THE INVENTION

The disclosed invention has been developed in response to the present state of the art and, in particular, in response to the problems and needs in the art that have not yet been fully solved by currently available components and methods. Accordingly, efficient structural components and methods have been developed to allow an elevator to be driven from the bottom using a rack and chain lifting device.

Consistent with the foregoing, an elevator is disclosed. The elevator comprises at least one rack and chain lifting device. The rack and chain lifting device comprises a rack and a chain. The rack comprises a profile of the chain. In some embodiments, the rack comprises a corner rack. In some embodiments, the corner rack has a truncated cubic configuration, and parallel to a front face, which comprises teeth, is a point where two back faces join at an angle formed by a corner in which the corner rack is mounted. The chain comprises a profile of the rack. In some embodiments, the chain comprises a silent chain. In some embodiments, the silent chain comprises a plurality of connecting pins and a plurality of link plates. The link plates are stacked in alternating rows and bendably joined together by inserting the connecting pins through pin holes in the link plates. The link plates have teeth that are shaped in such a way that the teeth of the alternating rows of link plates are offset when the silent chain is straightened, such that a profile of the silent chain corresponds with a profile of a rack.

In some embodiments, the rack and chain lifting device of the elevator further comprises a plurality of gears. The gears have profiles that correspond to the profile of the chain. In some embodiments, the rack and chain lifting device of the elevator further comprises a motor. The motor is connected to and drives the gears and the chain. In one embodiment, the elevator comprises four rack and chain lifting devices. In one embodiment, each of the four rack and chain lifting devices is mounted in a corner.

The elevator further comprises a floor, a transportable frame, and an elevator shaft. In one embodiment, the transportable frame comprises a plurality of modular triangular prismatic components. In one embodiment, a space between walls of the transportable frame and walls of the elevator shaft measures about one-sixteenth inch. In one embodiment, length and width measurements of the elevator shaft are large enough to fit four people inside the elevator.

In some embodiments, the elevator further comprises an elevator box façade, a fabric door, a power supply system, a control system, or a braking system. In some embodiments, the fabric door comprises an adjacent door. In some embodiments, the fabric door further comprises a light curtain. In one embodiment, the power supply system comprises battery power. Finally, in one embodiment, the braking system comprises centrifugal brakes.

BRIEF DESCRIPTION OF THE DRAWINGS

A more particular description of the invention briefly described above is made below by reference to specific embodiments depicted in drawings included with this application, in which.

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

Figure 1:
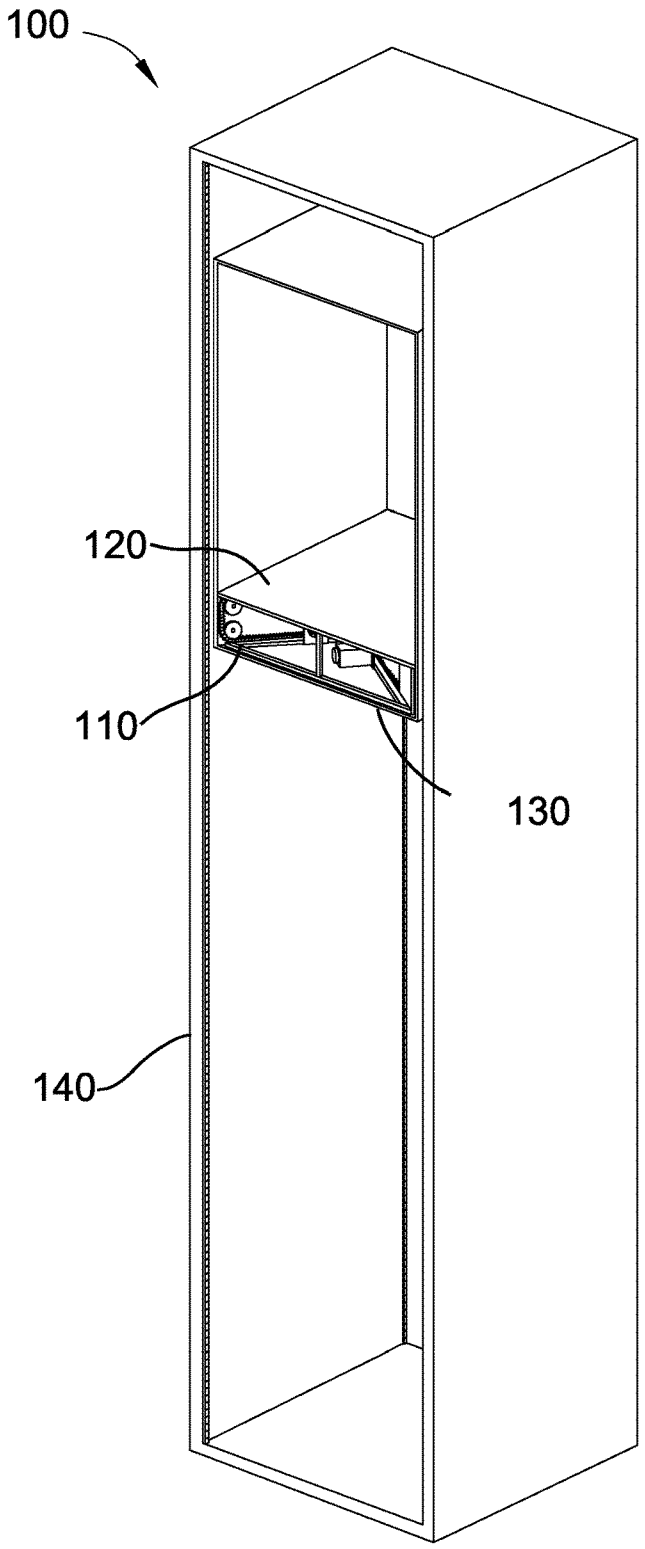
FIG. 1 depicts a perspective view of one embodiment of an elevator built in accordance with the invention.

FIG. 1 depicts one embodiment of an elevator 100 built in accordance with the invention. The elevator 100 is a rack and chain driven elevator, in which the elevator is driven from the bottom. The elevator 100 comprises at least one rack and chain lifting device 110. The elevator 100 further comprises a floor 120, a transportable frame 130, and an elevator shaft 140.

The at least one rack and chain lifting device 110 comprises a rack and a chain. The rack comprises a profile of the chain, and the chain comprises a profile of the rack. The next several figures will depict the at least one rack and chain lifting device in more detail.

Figure 2A:
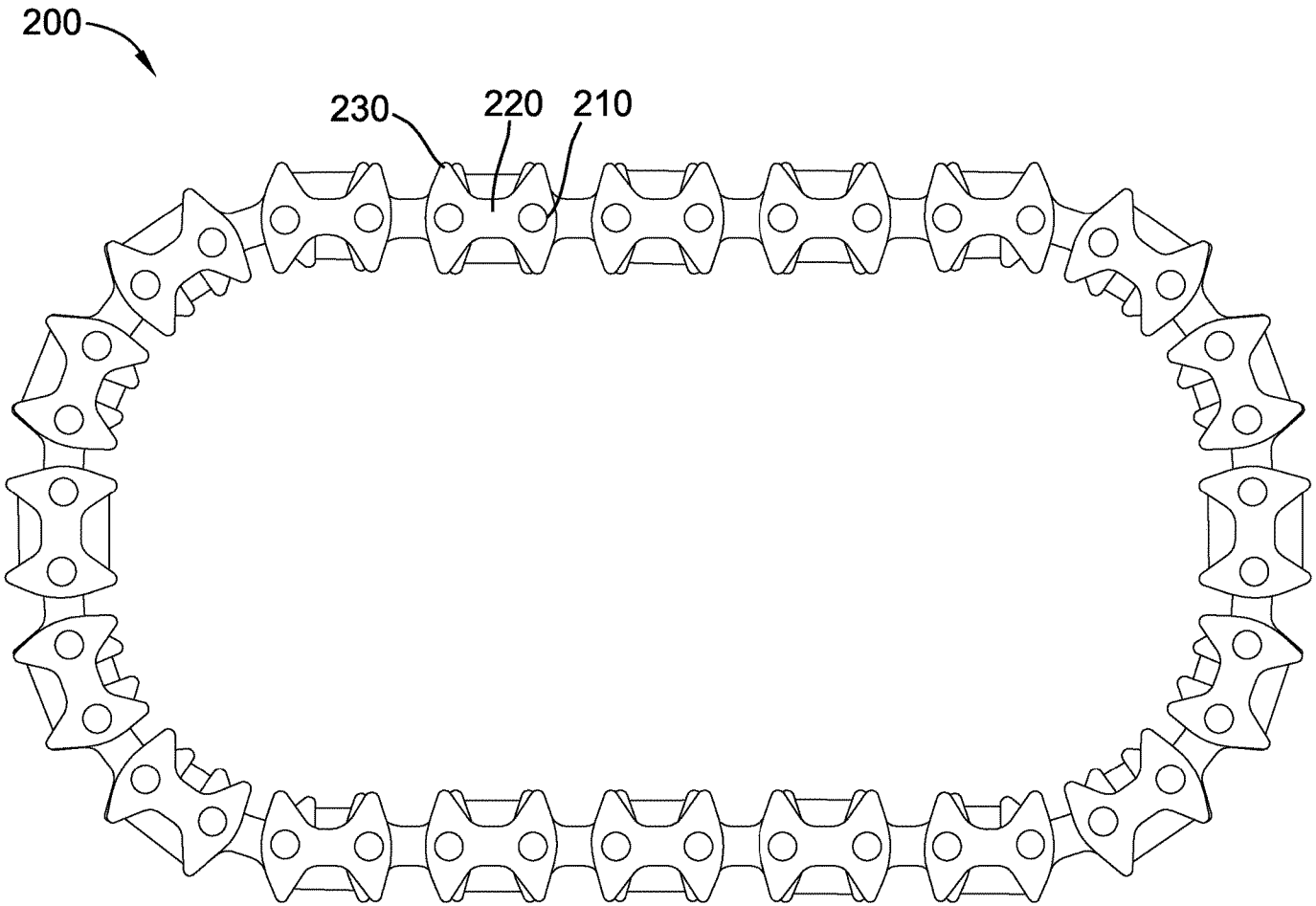
FIG. 2A depicts a perspective view of one embodiment of a chain of the at least one rack and chain lifting device of the elevator.
Figure 2C:
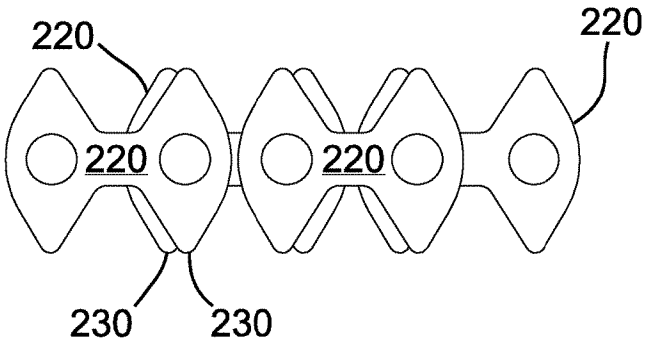
FIG. 2C depicts an exploded view of link plates stacked in alternating views.
Figure 2E:
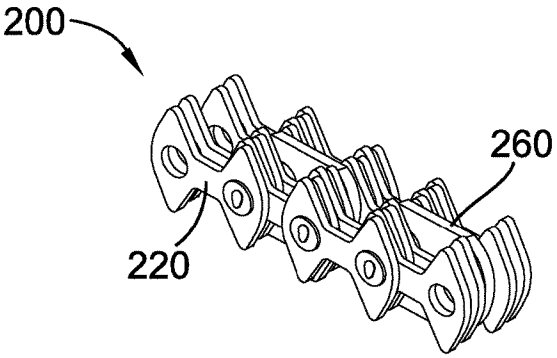
FIG. 2E depicts a side view of one embodiment of the chain.
Figure 2B:
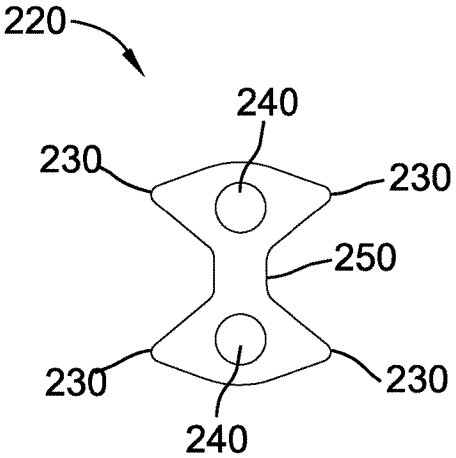
FIG. 2B depicts an exploded view of one embodiment of a single link plate.

FIG. 2A, FIG. 2B, FIG. 2C, FIG. 2D, and FIG. 2E depict one embodiment of a chain 200 of the at least one rack and chain lifting device of the elevator. FIG. 2A depicts one embodiment of the chain 200, in which the chain 200 comprises a silent chain. In one embodiment, the chain 200 comprises a plurality of connecting pins 210 and a plurality of link plates 220. The link plates 220 are stacked in alternating rows and bendably joined together by inserting the connecting pins 210 through pin holes in the link plates 220. The link plates 220 have teeth 230 that are shaped in such a way that the teeth 230 of the alternating rows of link plates are offset when the chain 200 is straightened, such that a profile of the chain 200 corresponds with a profile of a rack. FIG. 2B depicts one embodiment of a single link plate 220 of the chain. Each link plate 220 has at least four teeth 230 and two pin holes 240. In one embodiment, the link plates are bow-shaped. A tip of each of the teeth 240 of the link plates 220 forms an angle between about thirty and eighty degrees, preferably an angle between about fifty-five and sixty degrees. Each of the teeth 230 of the link plates 220 extends from a vertical waist 250 of each link plate 220 at an angle between about one hundred and one hundred fifty degrees, preferably an angle of between about one hundred twenty-five and one hundred thirty degrees. A distance between central pivot points within each pin hole of the link plates 220 measures 0.5 inches. A distance between central points of two teeth 230 that are pointing a same direction measures between about 0.345 and 0.79 inches, preferably measuring between about 0.49 and 0.68 inches, more preferably measuring between about 0.55 and 0.645 inches.

Figure 2D:
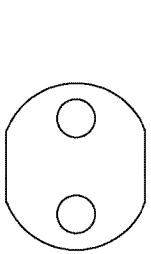
FIG. 2D depicts an exploded view of a center guide link plate.

These measurements make it so that the teeth 230 of the link plates 220 are shaped in such a way that, when the link plates 220 are stacked in alternating rows, the teeth 230 of a first row selection of link plates 220 and a second row selection of link plates 220 are offset. Therefore, when the chain 200 is straightened, the profile of the chain 200 corresponds with a profile of a rack. FIG. 2C depicts the link plates 220 stacked in alternating rows. When the link plates 220 are stacked in alternating rows, the teeth 230 of the link plates 220 are offset. FIG. 2D depicts one embodiment of a center guide link plate 260. Center guide link plates 260 are stadium-shaped and have no teeth. Center guide link plates 260 are positioned centrally between the rows of link plates 220. They are designed to correspond with center guide indentations on a rack, to prevent the chain 200 from slipping when it engages with the rack. FIG. 2E depicts an exploded side view of one embodiment of the chain 200. The chain 200 has a variable length and a variable amount of alternating rows of link plates 220. In FIG. 2E, one embodiment of the chain 200 is depicted, in which there are eight alternating rows of link plates 220, plus center guide link plates 260. The center guide link plates 260 can be seen centrally positioned between alternating rows of link plates 220. In other embodiments, the chain 200 has any number of alternating rows of link plates 220.

Figure 3A:
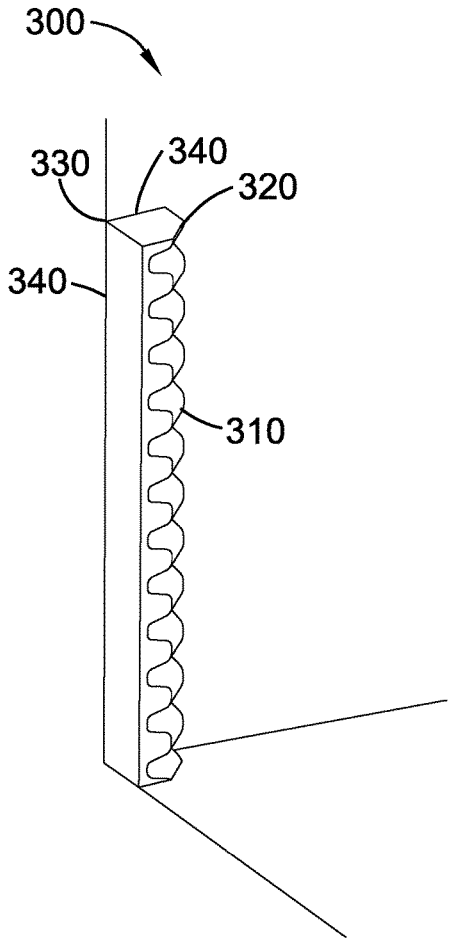
FIG. 3A depicts a perspective view of one embodiment of a rack of the at least one rack and chain lifting device.
Figure 3B:
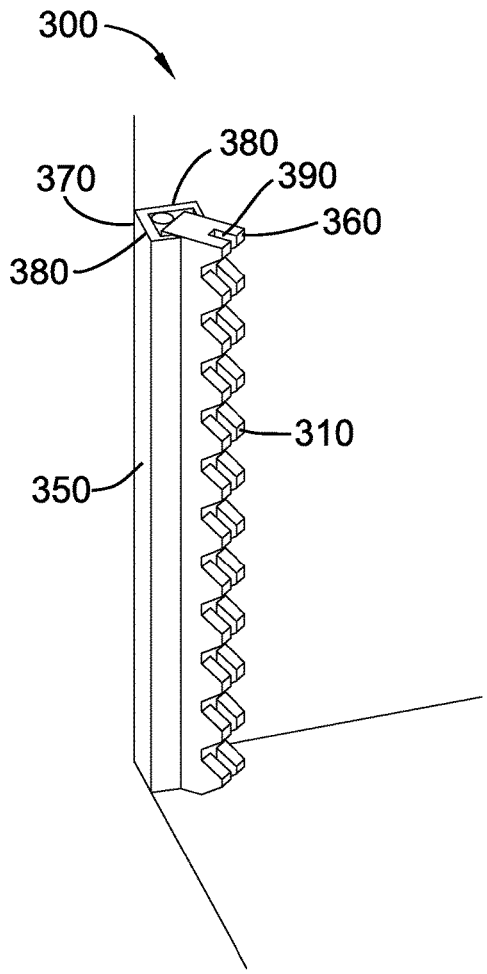
FIG. 3B depicts a perspective view of one embodiment of a rack of the at least one rack and chain lifting device.

FIG. 3A and FIG. 3B depict embodiments of the rack 300 of the at least one rack and chain lifting device. A rack is a linear gear interface with a plurality of teeth 310. The rack 300 comprises a profile of the chain of the at least one rack and chain lifting device. In one embodiment, the pitch of the rack 300 measures between about 0.345 and 0.79 inches, preferably measuring between about 0.41 and 0.63 inches, more preferably measuring between about 0.48 and 0.58 inches. The pitch of the rack 300 must be slightly bigger than the distance between central pivot points within each pin hole of the link plates of the chain of the at least one rack and chain lifting device in order for the profile of the rack 300 to engage with the profile of the chain. In one embodiment, teeth 310 of the rack 300 extend from a main body of the rack 300 at an angle between about 90 and 130 degrees, preferably at an angle between about 100 and 120 degrees, more preferably at an angle between about 105 and 115 degrees. These measurements make it so that a profile of the rack 300 corresponds with a profile of the chain of the at least one rack and chain lifting device. In one embodiment, the rack 300 is a corner rack. FIG. 3A depicts one embodiment of the rack 300, in which the rack 300 has a truncated cubic configuration. Parallel to a front face 320, which comprises teeth 310, is a point 330 where two back faces 340 join at an angle formed by a corner in which the rack 300 is mounted. FIG. 3B depicts another embodiment of the rack 300, in which the rack 300 has a cubic configuration. The rack 300 is displaced within and secured by a bracket 350 with a truncated cubic configuration. Parallel to a front face 360 is a point 370 where two back faces 380 of the bracket 350 join at an angle formed by a corner in which the corner rack is mounted. FIG. 3B also depicts one embodiment of the rack 300, in which the rack 300 has a center guide indentation 390 that corresponds with center guide link plates in one embodiment of the chain of the at least one rack and chain lifting device, in order to prevent the chain from slipping when it engages with the rack 300. In some embodiments, the rack 300 has a trapezoid configuration. In some embodiments, the rack 300 is tubular.

Figure 4:
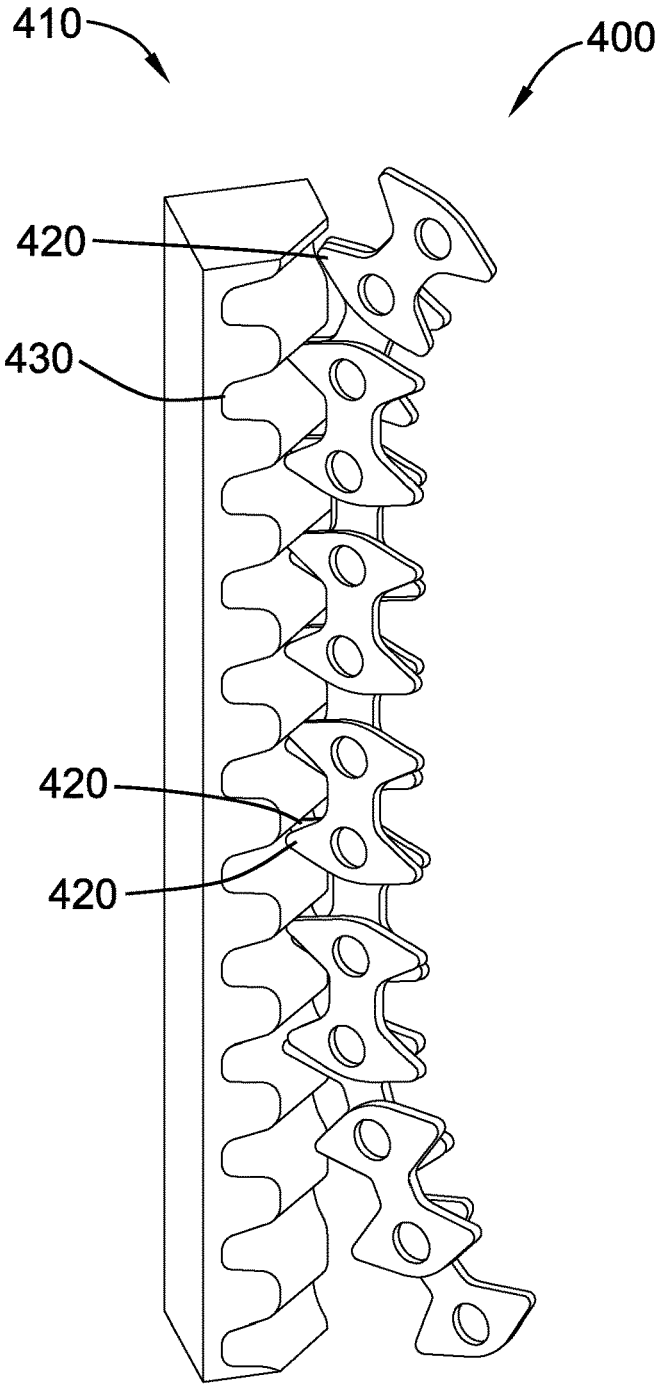
FIG. 4 depicts an exploded view of a profile of one embodiment of a chain of the at least one rack and chain lifting device of the invention engaging with a profile of one embodiment of a rack of the at least one rack and chain lifting device of the invention.

FIG. 4 depicts a profile of one embodiment of chain 400 of the at least one rack and chain lifting device of the invention engaging with a profile of one embodiment of the rack 410 of the at least one rack and chain lifting device of the invention. The profile of chain 400 comprises a profile of rack 410. The teeth 420 of the link plates of chain 400 are shaped in such a way that the teeth 420 are offset when the chain 400 is straightened. However, as the chain 400 is bent so that the teeth 420 approach the rack 410 to engage with the rack 410, an upper portion of the teeth 420 align. Because the teeth 420 align, the teeth 420 become small enough to fit within a groove 430 of the rack 410. After the silent chain 400 is straightened, the teeth 420 are drawn apart, such that they return to their original offset position. In this way, the teeth 420 are able to engage with rack 410.

Figure 5:
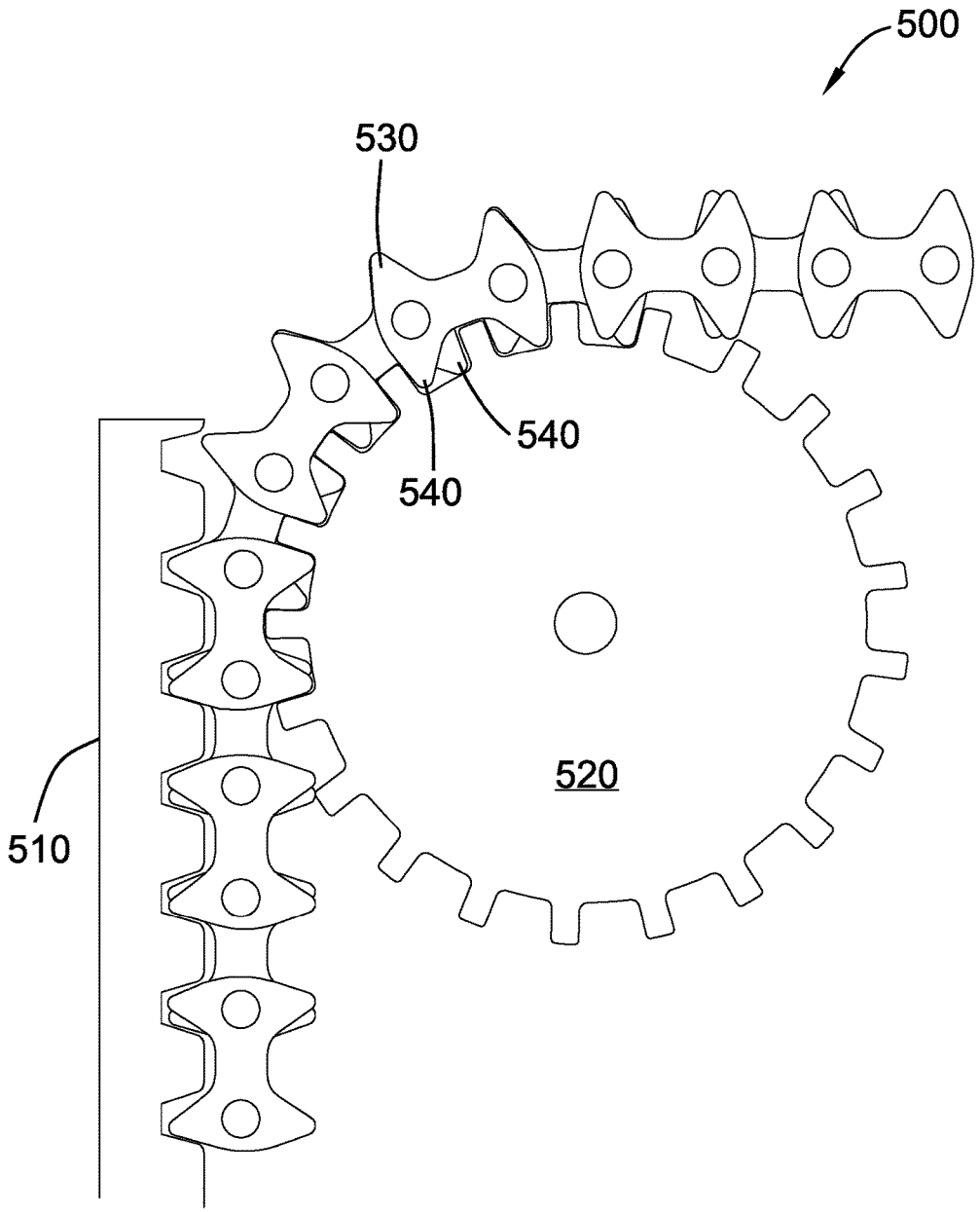
FIG. 5 depicts an exploded view of one embodiment of a chain of the at least one rack and chain lifting device of the invention engaging with both a profile of one embodiment of a gear and a profile of one embodiment of a rack.

FIG. 5 depicts one embodiment of chain 500 of the at least one rack and chain lifting device of the invention engaging with both a profile of one embodiment of a gear 520 and a profile of one embodiment of a rack 510. Due to the profile of chain 500, the chain 500 is able to engage with a gear 520 on the inside and a rack 510 on the outside at the same time. Because the teeth of the link plates of chain 500 are offset when straightened, chain 500 can engage with a rack 510. Because, when the silent chain 500 is bent, though upper teeth 530 align, lower teeth 540 are still drawn apart, continuing in their original offset position, the chain 500 is able to engage with a gear 520. The gear 520 can be connected to a motor. The motor drives gear 520 and the chain 500, such that the chain 500 can move up the rack 510, converting rotational motion into linear motion.

Figure 6:
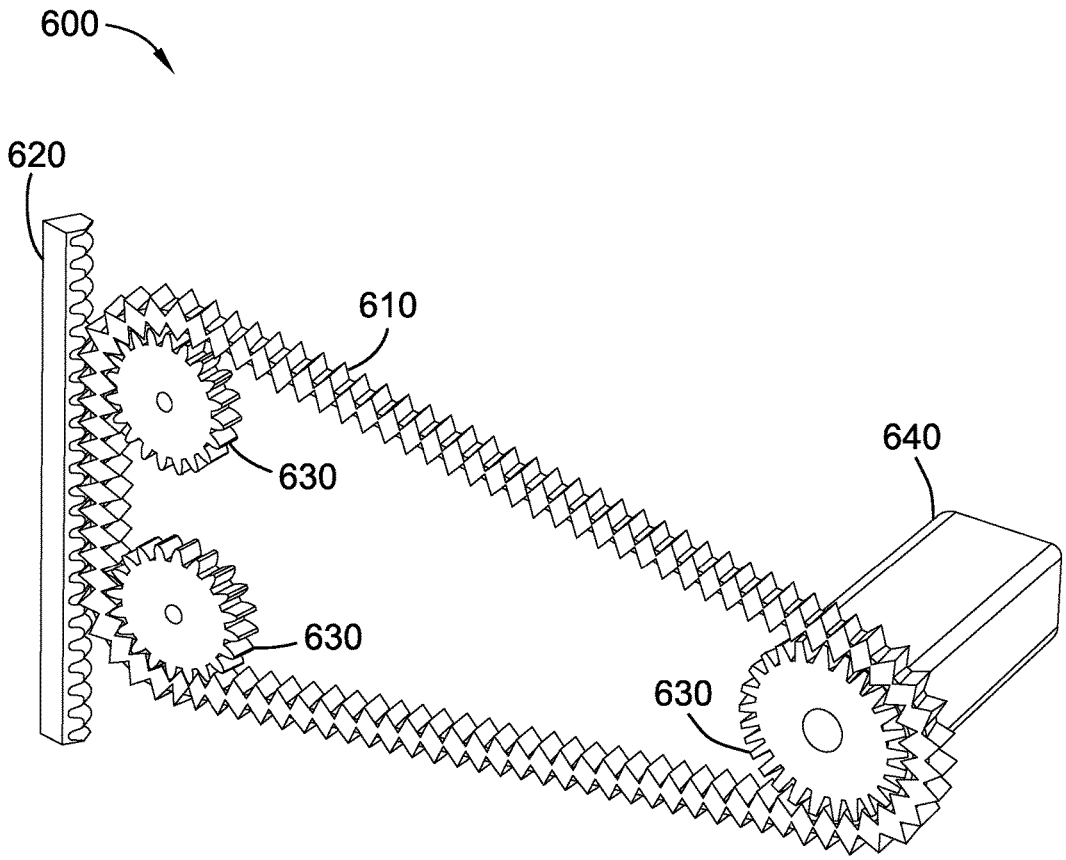
FIG. 6 depicts a perspective view of one embodiment of the at least one rack and chain lifting device.

FIG. 6 depicts one embodiment of the at least one rack and chain lifting device 600. The elevator comprises at least one rack and chain lifting device 600. In one embodiment, the elevator comprises four rack and chain lifting devices 600. Each rack and chain lifting device comprises a rack 620 and a chain 610. The rack 620 comprises a profile of the chain 610, and the chain 610 comprises a profile of the rack 620. In one embodiment, each rack and chain lifting device 600 further comprises a plurality of gears 630. The gears 630 have a profiles that correspond to the profile of the chain 610. In one embodiment, each rack and chain lifting device 600 further comprises a motor 640. The motor 640 is connected to and drives the gears 630 and the chain 610. In FIG. 6, embodiments of a chain 610, a rack 620, a plurality of gears 630, and a motor 640 are assembled to create one embodiment of the at least one rack and chain lifting device 600. The motor 640 is connected to and drives the gears 630 and the chain 610. In one embodiment, a shaft extending from the motor 640 is inserted through a middle hole of one gear 630, connecting the motor 640 to the gear 630. In one embodiment, a brake secures the motor 640 in place on the gear 630. At a distance from the first gear 630 that allows the chain 610 to stretch to its full extent, at least two other gears 630 are placed. The chain 610 is wrapped around each of the gears 630, and the teeth of the chain 610 engage with the teeth of the gears 630. The rack 620 is positioned vertically. The rack 620, the chain 610, the gears 630, and the motor 640 are positioned such that the portion of the chain 610 stretching between two gears 630, these gears being opposite the gear attached to the motor 640, can engage with the rack 620. The motor 640 and the attached gear 630 should be distanced from the rack 620 to the extent that allows the chain 610 to be fully extended.

Figure 7B:
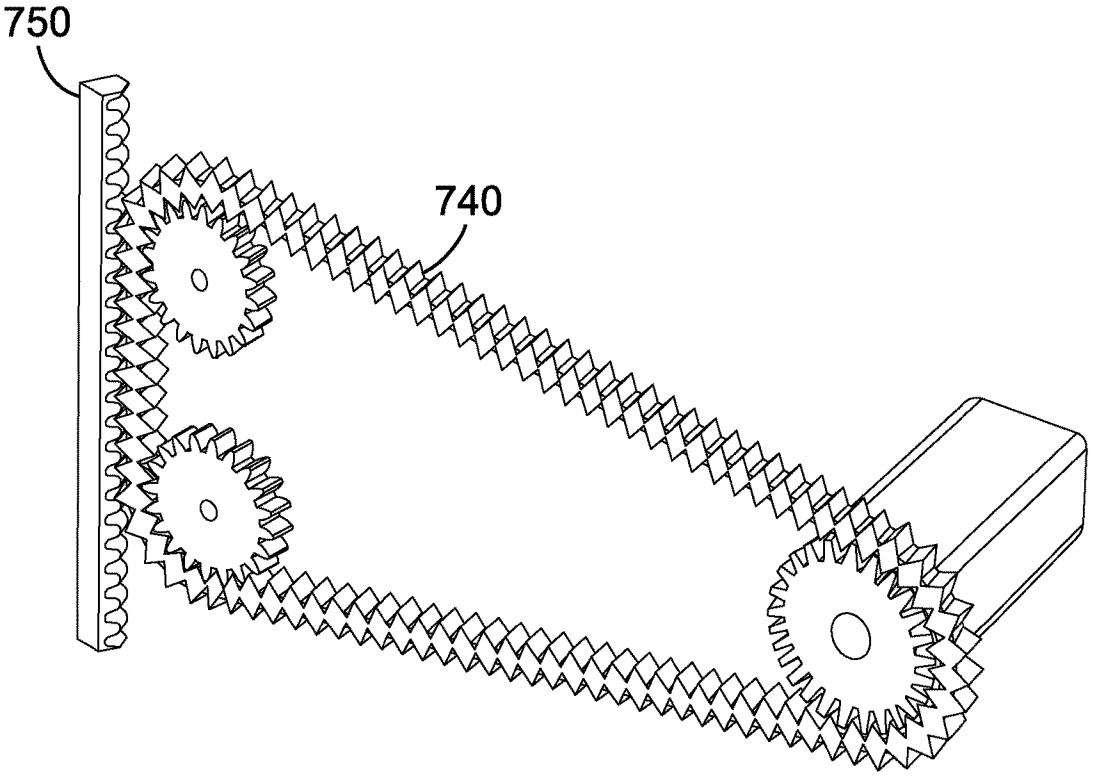
FIG. 7B depicts a perspective view of points of contact between a rack and a chain in the at least one rack and chain lifting device.
Figure 7A:
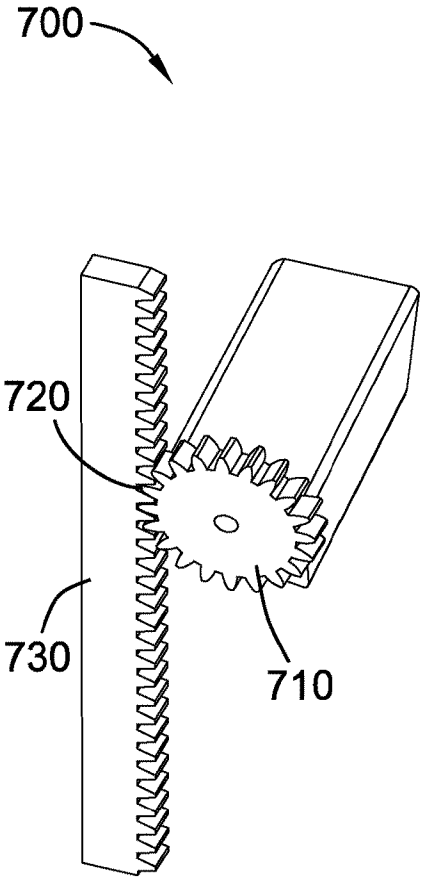
FIG. 7A depicts a perspective view of points of contact between a rack and a pinion in a rack and pinion device.

FIG. 7A and FIG. 7B depict a comparison of points of contact between a rack and a pinion in a rack and pinion device and points of contact between a rack and a chain in the at least one rack and chain lifting device. FIG. 7A depicts an ordinary rack and pinion device 700. Only a few teeth 720 of the pinion 710 make contact with the rack 730. Due to the small number of points of contact, these points of contact may be put under undue amounts of stress when lifting heavy loads, which could cause the rack and pinion device to fail. On the other hand, FIG. 7B depicts the chain 740 of the invention engaged with a rack 750. In this case, multiple points of contact exist between the rack 750 and the chain 740. For this reason, the at least one rack and chain lifting device is stronger and able to hold more weight. In addition, only small parts are needed, thus increasing the efficiency and decreasing the cost of lifting heavy loads from underneath.

Figure 8A:
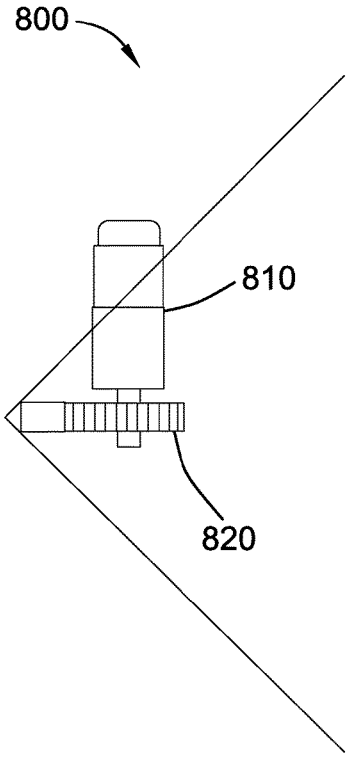
FIG. 8A depicts a perspective view of a rack and pinion device in a corner.
Figure 8B:
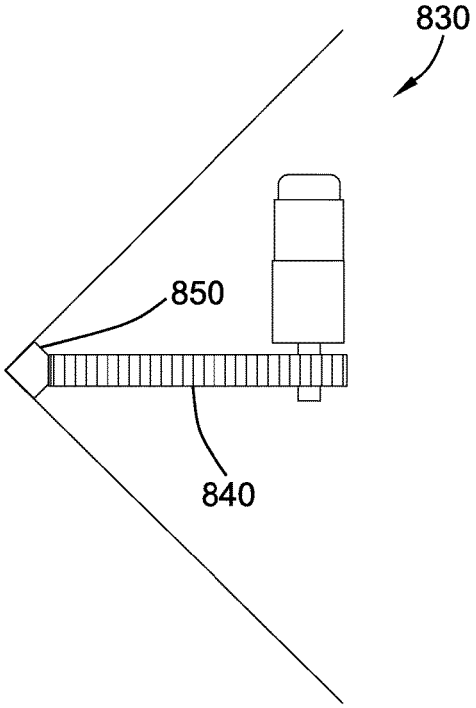
FIG. 8B depicts a perspective view of the at least one rack and chain lifting device in a corner.

FIG. 8A and FIG. 8B depict a comparison between a rack and pinion device in a corner and the at least one rack and chain lifting device in a corner. FIG. 8A depicts a rack and pinion device 800 in a corner. Rack and pinion devices generally are not placed in corners because a motor 810 extending out from the pinion 820 is generally too large to fit in a space available within an angle of a corner. This problem could be solved by adding gears between the rack and the pinion, but that would increase cost and reduce efficiency. FIG. 8B depicts the at least one rack and chain lifting device 830 in a corner. In the at least one rack and chain lifting device 830, the chain 840 engaging with the rack 850, in place of a pinion engaging with a rack, allows a motor 860 to be distanced from the rack 850, as far away as the length of the chain 840 allows. This, in combination with a corner rack, allows the at least one rack and chain lifting device 830 to be placed in and utilized in corners.

Figure 9:
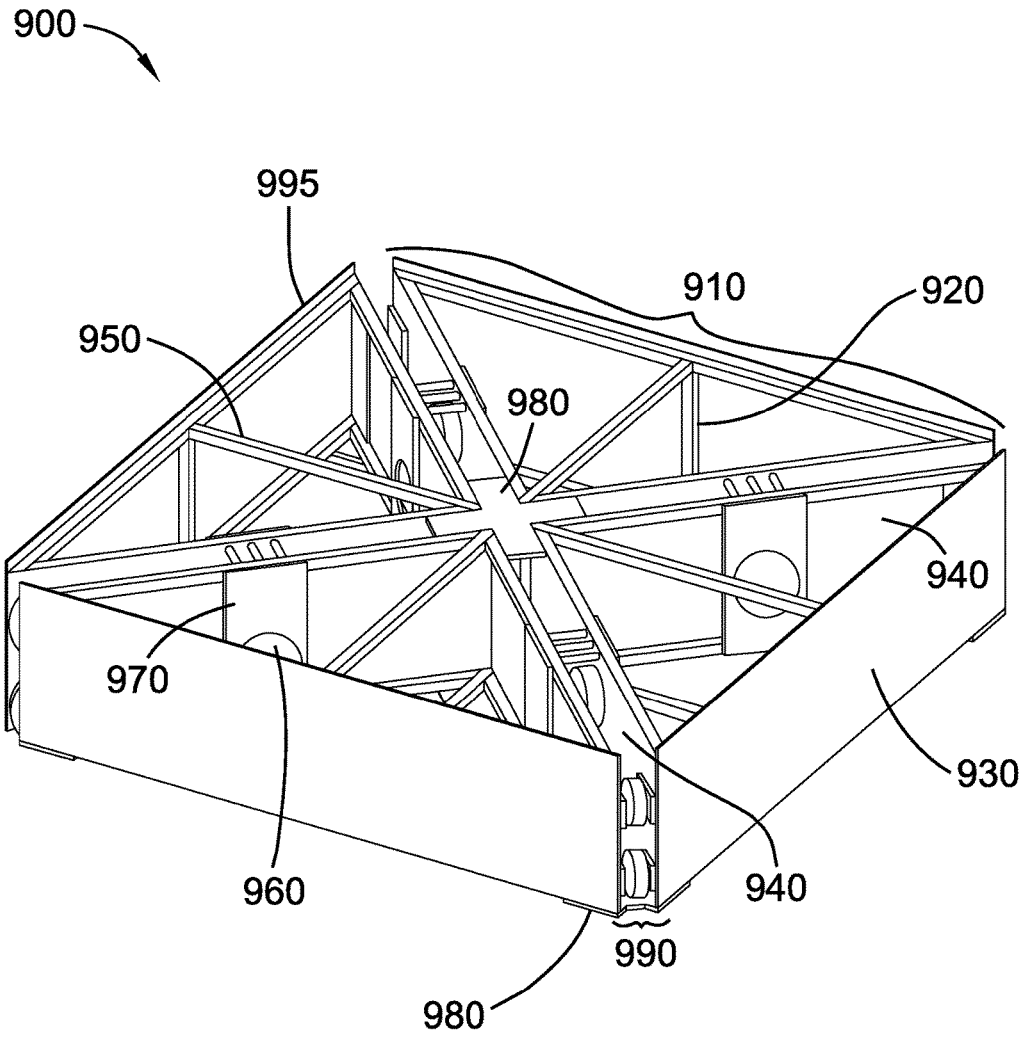
FIG. 9 depicts a perspective view of one embodiment of a transportable frame.

FIG. 9 depicts one embodiment of a transportable frame 900. A transportable frame is a supporting structure, which holds the at least one rack and chain lifting device, attaching it to and supporting a floor. In one embodiment, the transportable frame 900 comprises aluminum. In other embodiments, the transportable frame 900 comprises another lightweight metal, such as aluminum, magnesium, titanium, beryllium alloys, or combinations thereof. In still other embodiments, the transportable frame 900 comprises OSB, reinforced OSB, lightweight OSB, or other engineered materials, such as engineered wood, composite board, particle board, press board, plywood, wood laminate, chip board, gypsum board, cement board, carbon fiber materials, or combinations thereof. In one embodiment, the transportable frame 900 has a configuration identical to the configuration of the elevator shaft. In one embodiment, the transportable frame 900 has a cuboid configuration. In one embodiment, a space between walls of the transportable frame 900 and walls of the elevator shaft measures about one inch, specifically measuring about one-eighth of an inch, more specifically measuring about one-sixteenth of an inch. In one embodiment, the transportable frame 900 comprises a plurality of modular triangular prismatic components 910. In one embodiment, the transportable frame 900 comprises four modular triangular prismatic components 910 arranged in a cuboid configuration. Each modular triangular prismatic component 910 comprises a plurality of beams 920 arranged in a triangular prismatic skeletal transportable frame and three walls, an outer wall 930 and two inner walls 940. A cross-beam 950 extends through the middle of each modular triangular prismatic component 910 for extra weight support. Two inner walls 940 have a cutout hole 960 to hold a motor. A bracket 970 with a corresponding cutout hole is secured over each cutout hole, to provide extra support to hold a motor. The modular triangular prismatic components 910 are arranged in a cuboid configuration and attached with plates 980. A space between each triangular prismatic component 990 is large enough to hold a rack and chain lifting device. A lip 995 extends slightly above each outer wall 930 to secure a floor in place. In one embodiment, the transportable frame 900 can hold four rack and chain lifting devices. In one embodiment, each of the four rack and chain lifting devices are mounted in a corner, one in each corner of the cuboid configuration of the transportable frame 900. The presence of four rack and chain lifting devices allows each of the rack and chain lifting devices to be smaller, so that an elevator can be driven from the bottom within a compact space. This reduces cost and increases efficiency. The presence of four rack and chain lifting devices also provides more power. If one of the rack and chain lifting devices fails, there are at least three backup rack and chain lifting devices, which makes the elevator safer. Each rack and chain lifting device can be powered by a battery, so that the elevator can still run in the event of an emergency or an electrical outage, even when one rack and chain lifting device fails. Positioning the rack and chain lifting devices in four corners allows for increased versatility and access to the elevator. For example, the elevator can have two adjacent doors. Furthermore, the corner racks of the rack and chain lifting devices can constitute part of the structural transportable frame of an elevator shaft, which again increases efficiency. Finally, the four rack and chain lifting devices help to balance and equally distribute weight held by the elevator.

Figure 10:
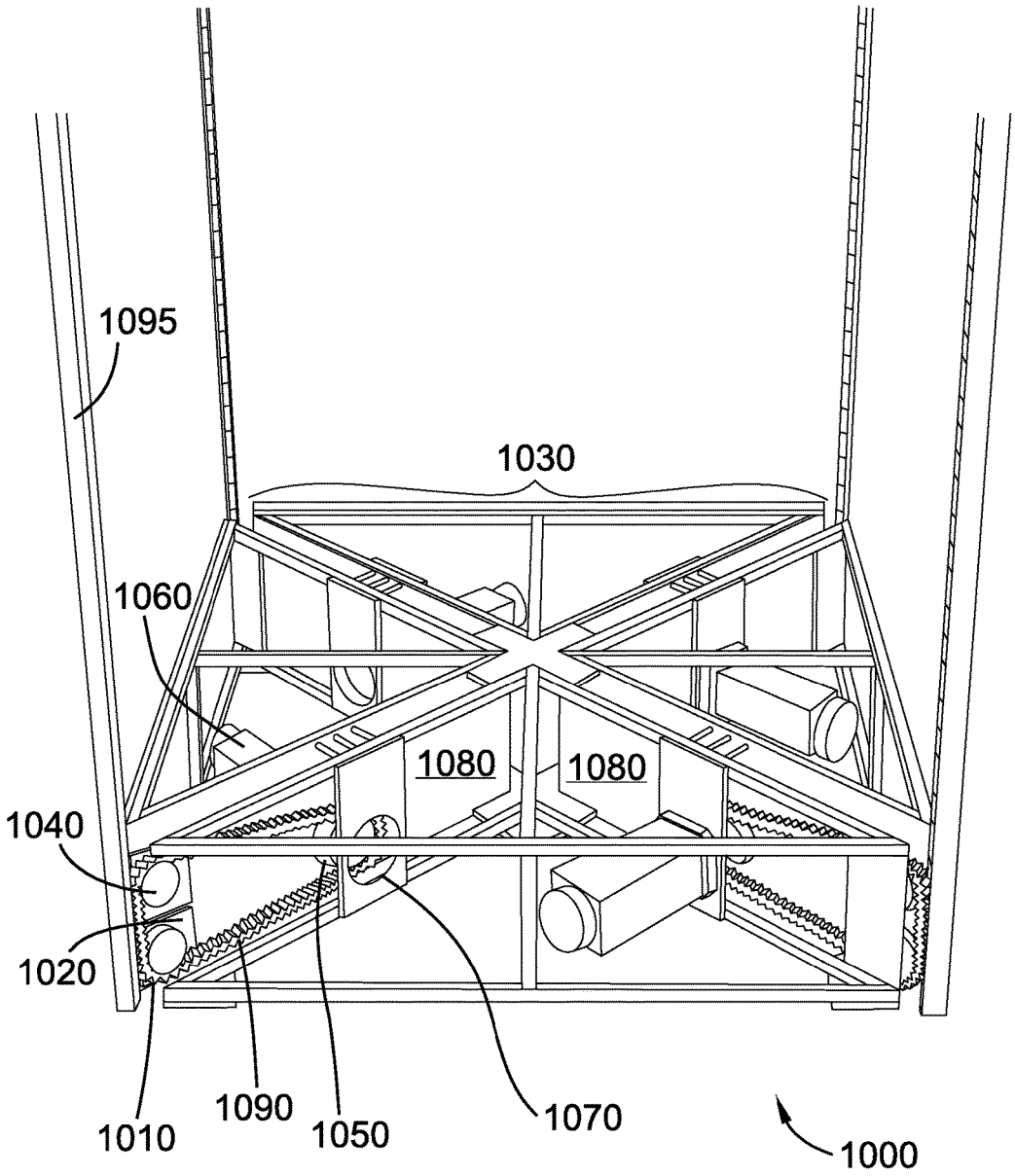
FIG. 10 depicts a perspective view of one embodiment of a transportable frame and at least one rack and chain lifting device.

FIG. 10 depicts one embodiment of a transportable frame 1000 and at least one rack and chain lifting device 1010. In FIG. 10, the inner and outer walls of the front modular triangular prismatic component of the transportable frame are not shown, so that an inside view of the transportable frame is visible. In one embodiment, the elevator comprises four rack and chain lifting devices 1010. In one embodiment, each of the four rack and chain lifting devices 1010 is mounted in a corner of the transportable frame 1000. In one embodiment, the rack and chain lifting devices are secured in the following manner. A plurality of tensioners 1020 are secured on an edge of each modular triangular prismatic component 1030. In a space between two modular triangular prismatic components 1030, a plurality of gears 1040 are secured between two tensioners 1020. Another gear 1050 is attached to a motor 1060. The motor 1060 with the attached gear 1050 is secured inside cutout holes 1070 of inner walls 1080 of the transportable frame 1000. In one embodiment, a brake secures the gear 1050 on the motor 1060. A chain 1090 is wrapped around the gears 1040 and 1050. A rack 1095 is positioned vertically, such that a portion of the chain 1090 stretching between gears 1040 can engage with the rack 1095. The motor 1060 drives the gears 1040 and 1050 and the chain 1090, such that the chain 1090 can move up the rack 1095, converting rotational motion to vertical linear motion for lifting.

Figure 11:
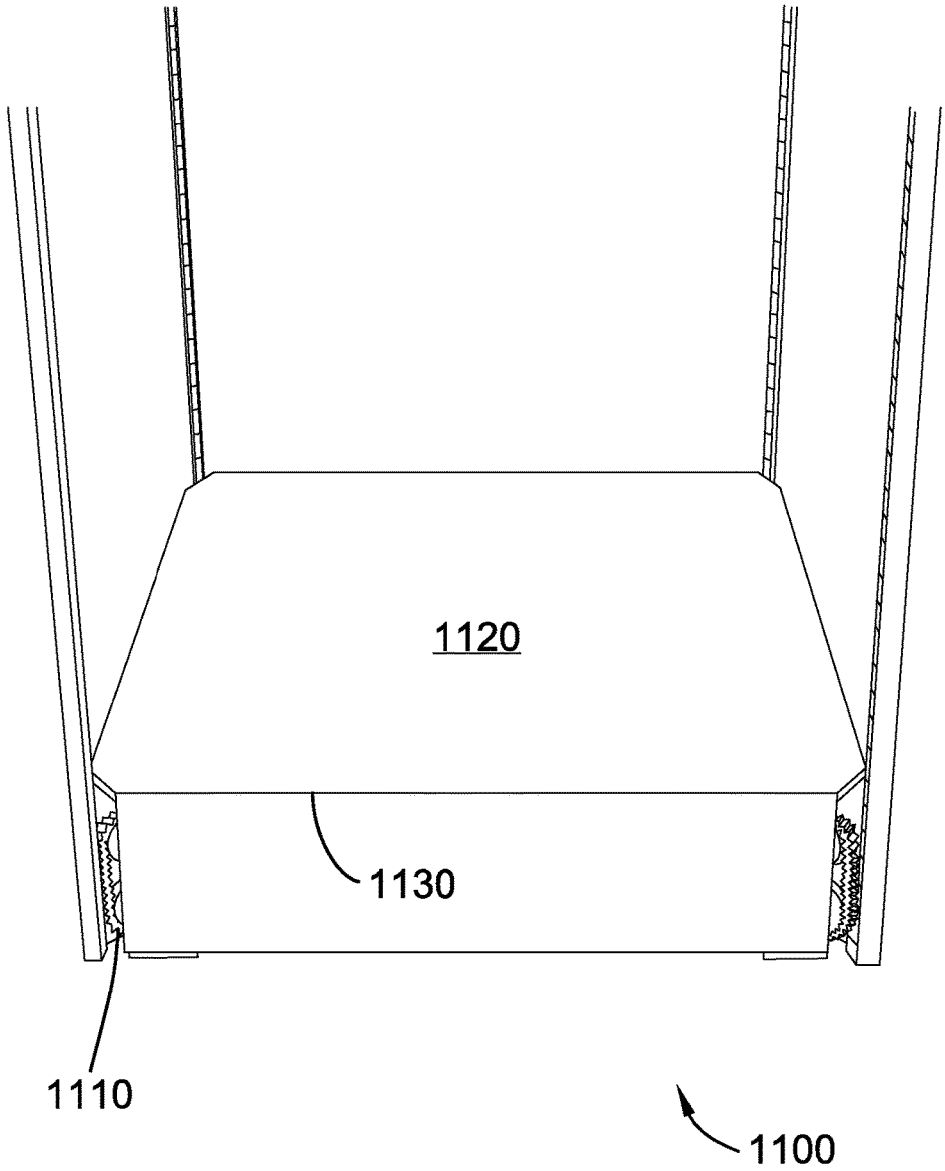
FIG. 11 depicts a perspective view of one embodiment of a transportable frame, at least one rack and chain lifting device, and a floor.

FIG. 11 depicts one embodiment of a transportable frame 1100, at least one rack and chain lifting device 1110, and a floor 1120. In one embodiment, the floor 1120 comprises OSB, reinforced OSB, lightweight OSB, or other engineered materials, such as engineered wood, composite board, particle board, press board, plywood, wood laminate, chip board, gypsum board, cement board, carbon fiber materials, or combinations thereof. In another embodiment, the floor 1120 comprises a lightweight metal, such as aluminum, magnesium, titanium, beryllium alloys, or combinations thereof. In other embodiments, the floor 1120 comprises plastic or optically transparent or semi-optically transparent materials, such as glass. The floor 1120 has length and width dimensions that correspond with length and width dimensions of the transportable frame 1100. In one embodiment, the floor 1120 is unsecured, floating freely on top of the transportable frame. This allows for easy repairs. A lip 1130 that extends slightly above each outer wall of the transportable frame holds the floor in place. In another embodiment, the floor 1120 is secured to the transportable frame 1100 using connectors or by welding.

Figure 12:
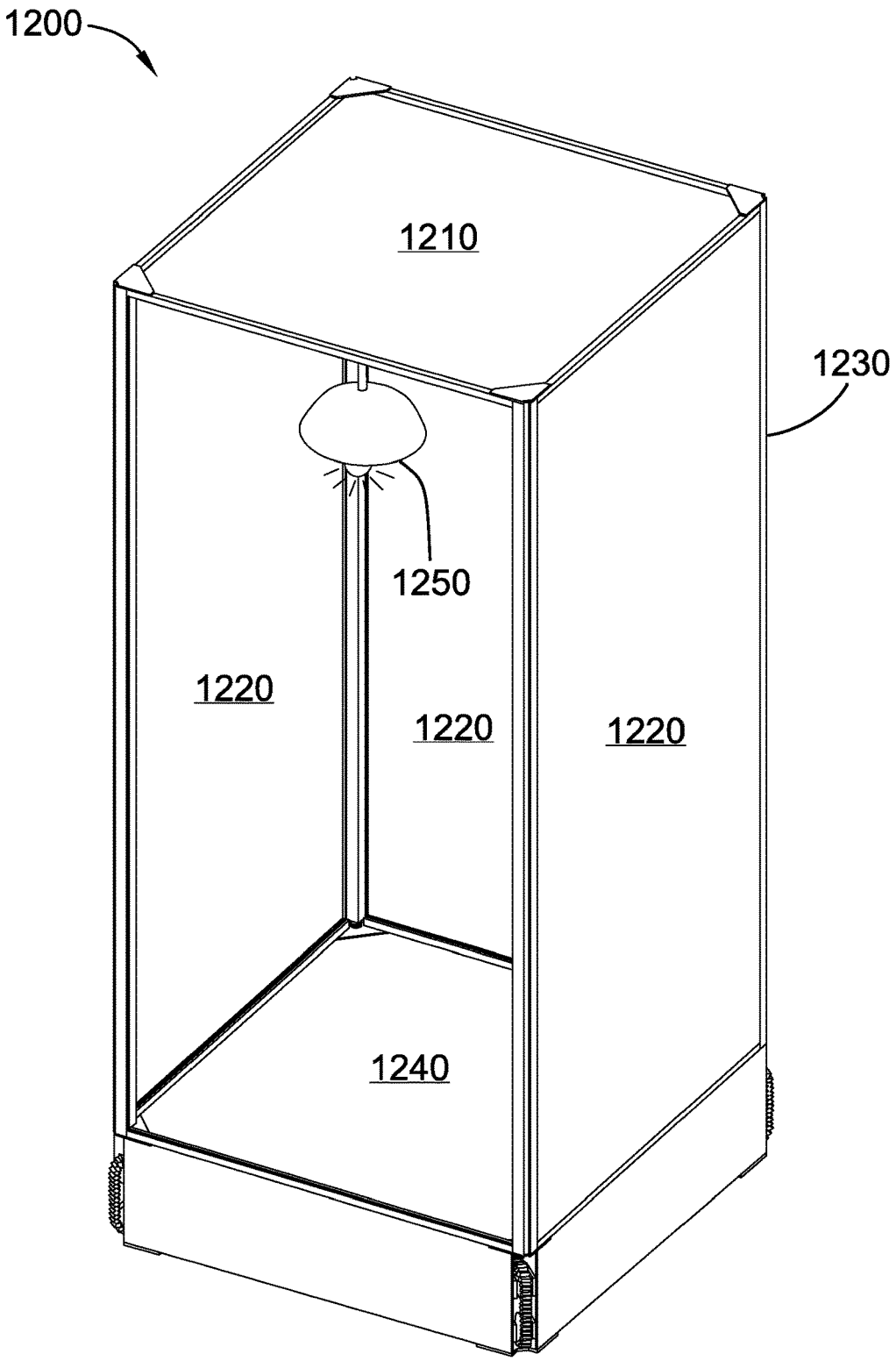
FIG. 12 depicts a perspective view of one embodiment of an elevator box façade.

In one embodiment, the elevator comprises an elevator box façade 1200. FIG. 12 depicts one embodiment of an elevator box façade 1200. In one embodiment, the elevator box façade 1200 comprises a ceiling 1210, a plurality of walls 1220, and a lightweight metal transportable frame 1230. In some embodiments, the elevator box façade further comprises a door. The lightweight metal transportable frame 1230 is secured to a floor 1240 using connectors. The ceiling 1210 and the plurality of walls 1220 are secured to the lightweight metal transportable frame 1230 using connectors. The ceiling 1210 and the plurality of walls 1220 comprise lightweight materials. Because the elevator is driven from the bottom with at least one rack and chain lifting device, the elevator box does not play a structural role in lifting, as with prior art elevators driven from the top by pulley systems. Therefore, the elevator box can be can be foregone entirely or it can be constructed from lighter and cheaper materials, constituting an elevator box façade. In one embodiment, the elevator box façade 1200 comprises plastic. In other embodiments, the elevator box façade 1200 comprises reinforced OSB, lightweight OSB, or other engineered materials, such as engineered wood, composite board, particle board, press board, plywood, wood laminate, chip board, gypsum board, cement board, carbon fiber materials, or combinations thereof. In some embodiments, the elevator box façade 1200 comprises a lightweight metal, such as aluminum, magnesium, titanium, beryllium alloys, or combinations thereof. In other embodiments, the elevator box façade 1200 comprises optically transparent or semi-optically transparent materials, such as glass. In one embodiment, the elevator façade is equipped with an overhead light 1250 for visibility within the elevator box façade.

Figure 13:
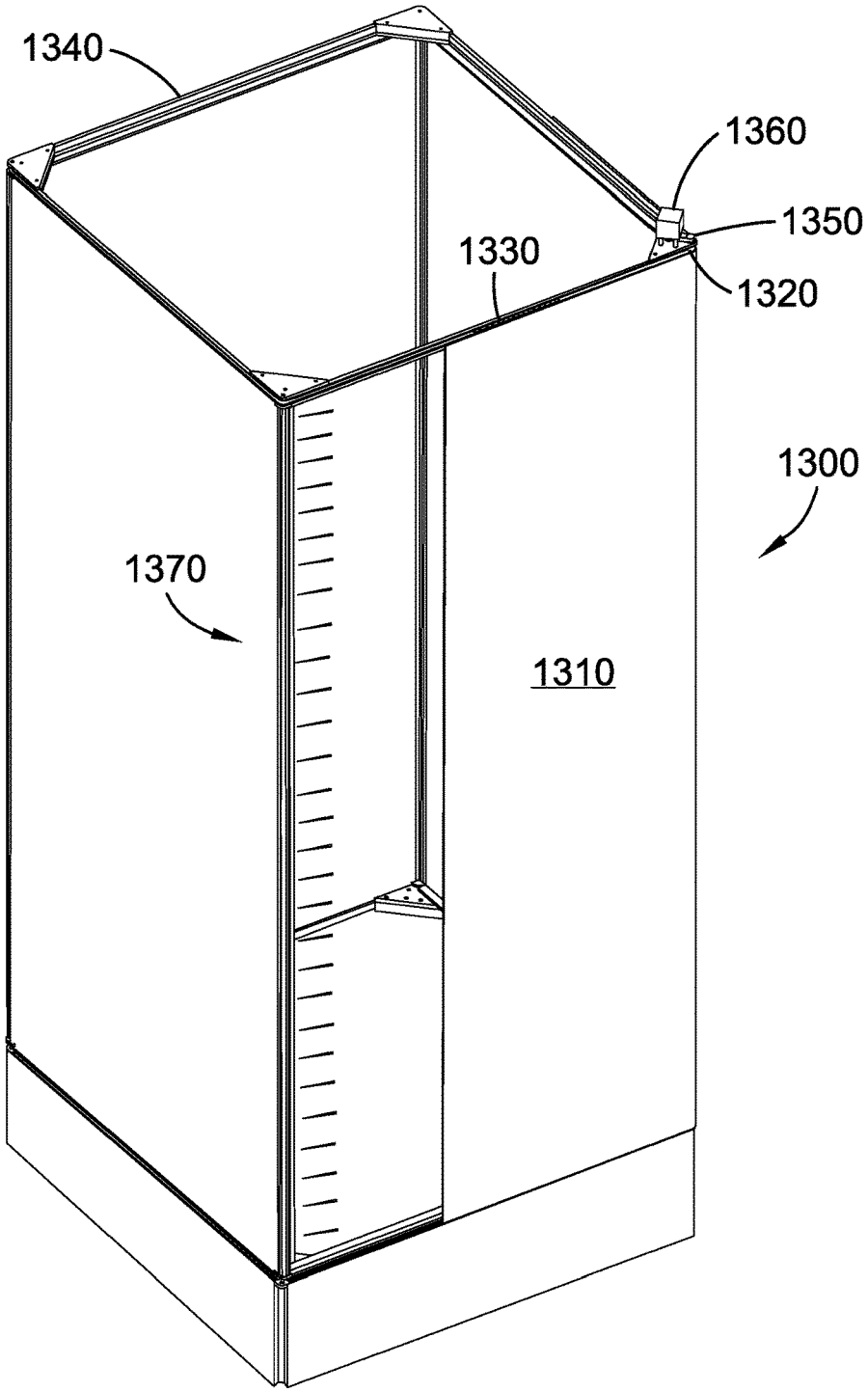
FIG. 13 depicts a perspective view of one embodiment of an elevator with a fabric door.

In one embodiment, the elevator comprises at least one fabric door. FIG. 13 depicts one embodiment of an elevator with a fabric door 1300. The fabric door 1300 comprises fabric 1310 stretched loosely between and attached to belts 1320 that run in tracks 1330 secured to top and bottom pieces of the lightweight metal transportable frame 1340 on at least one side of the elevator box façade. The belts 1320 rotate around pulleys 1350, which are attached to motors 1360, and which are used to move the fabric door 1300 in a sideways fashion, to open and close the fabric door 1300. In one embodiment, the fabric 1310 of the fabric door 1300 comprises ballistic nylon. In other embodiments, the fabric 1310 comprises woven, non-woven, knitted, or netting fabrics. In other embodiments, the fabric 1310 comprises synthetic fabrics or vinyl. In one embodiment, the fabric door 1300 further comprises a light curtain 1370. The light curtain 1370 is positioned just inside the fabric 1310. The light curtain 1370 creates a safety barrier. If the light curtain 1370 is triggered, the elevator will stop. Therefore, the fabric door 1300 cannot be opened while the elevator is in motion. In one embodiment, the at least one fabric door comprises a plurality of adjacent doors. Adjacent doors are doors that open on two adjacent sides of an elevator box. In an adjacent door, when the pulleys 1350 are used to move the fabric door 1300 in a sideways fashion, the fabric 1310 is not folded or bunched or constricted. The fabric 1310 retains its original shape—fully, though loosely, stretched. As the fabric door 1300 moves sideways along the tracks 1330, the fabric door 1300 overlaps, on the outside, an adjacent wall of the elevator box façade. Because the fabric door 1300 can travel either direction, left or right, at least two fabric doors can be adjacent to each other.

Figure 14:
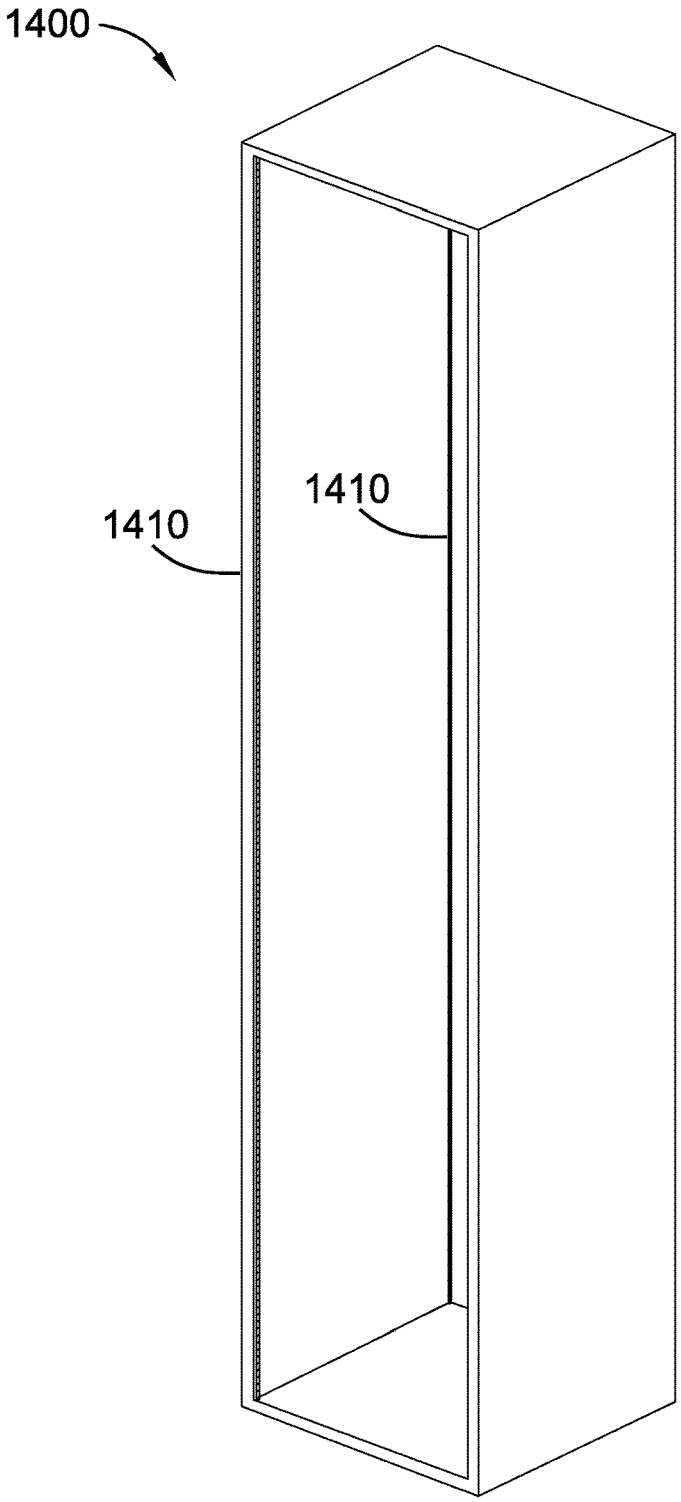
FIG. 14 depicts a perspective view of one embodiment of an elevator shaft.

FIG. 14 depicts one embodiment of an elevator shaft 1400. In one embodiment, the racks 1410 of at least one rack and chain lifting device are mounted in the corners of the elevator shaft 1400. In another embodiment, the racks 1410 of at least one rack and chain lifting device comprise the structural transportable frame of the elevator shaft. In one embodiment, length and width measurements of the elevator shaft 1400 are about four feet and one and one-half inch (1.295400 meters). These measurements allow the elevator to have a capacity of about four people, which corresponds with the weight lifting capacity of the elevator. The height of the elevator shaft 1400 is not limited. In prior art elevators, the height of an elevator shaft is limited by the length of a cable used as a pulley to lift the elevator. Because the elevator of the invention is driven from the bottom, there is no limit to the height of the elevator shaft 1400. A space between walls of the transportable frame and walls of the elevator shaft 1400 measures about one-sixteenth of an inch. This prevents the lightweight components of the elevator from being knocked over or from moving, which increases the security and safety of the elevator. In one embodiment, the elevator shaft 1400 has a removable top wall. This allows the elevator to drive clear up to the roof of a building, allowing access to the roof, without the need for an extension of the elevator shaft above the roof of the building. This leaves the roof space free for other uses.

Figure 15A:
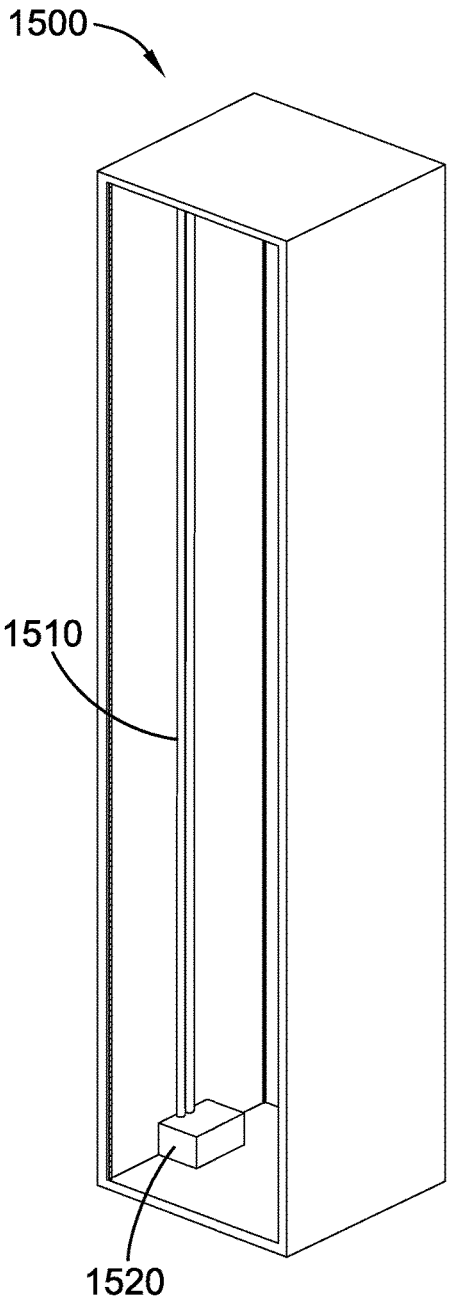
FIG. 15A depicts a perspective view of one embodiment of a power supply system of the elevator.
Figure 15B:
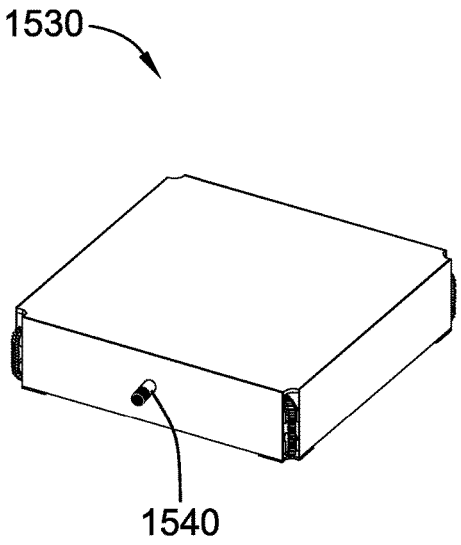
FIG. 15B depicts an exploded view of a transportable frame equipped with a carbon graphite brush.

In one embodiment, the elevator comprises a power supply system. FIG. 15A and FIG. 15B depict one embodiment of a power supply system of the elevator. In FIG. 15A, running vertically along a wall of the elevator shaft 1500 is at least one conductor rail 1510. At the foot of the conductor rail is a battery 1520. The battery 1520 can supply power to the elevator in the event of an emergency or an electrical outage. For this reason, unlike in prior art elevators, the elevator of the invention can still be used in an emergency. FIG. 15B depicts an elevator transportable frame. Protruding from the transportable frame 1530 of the elevator is a carbon graphite brush 1540, with wires running between the carbon graphite brush 1540 and a motor of the at least one rack and chain lifting device. The carbon graphite brush 1540 runs along the conductor rail 1510 as the elevator moves up and down, transferring electrical power from the conductor rail to the motors.

Figure 16:
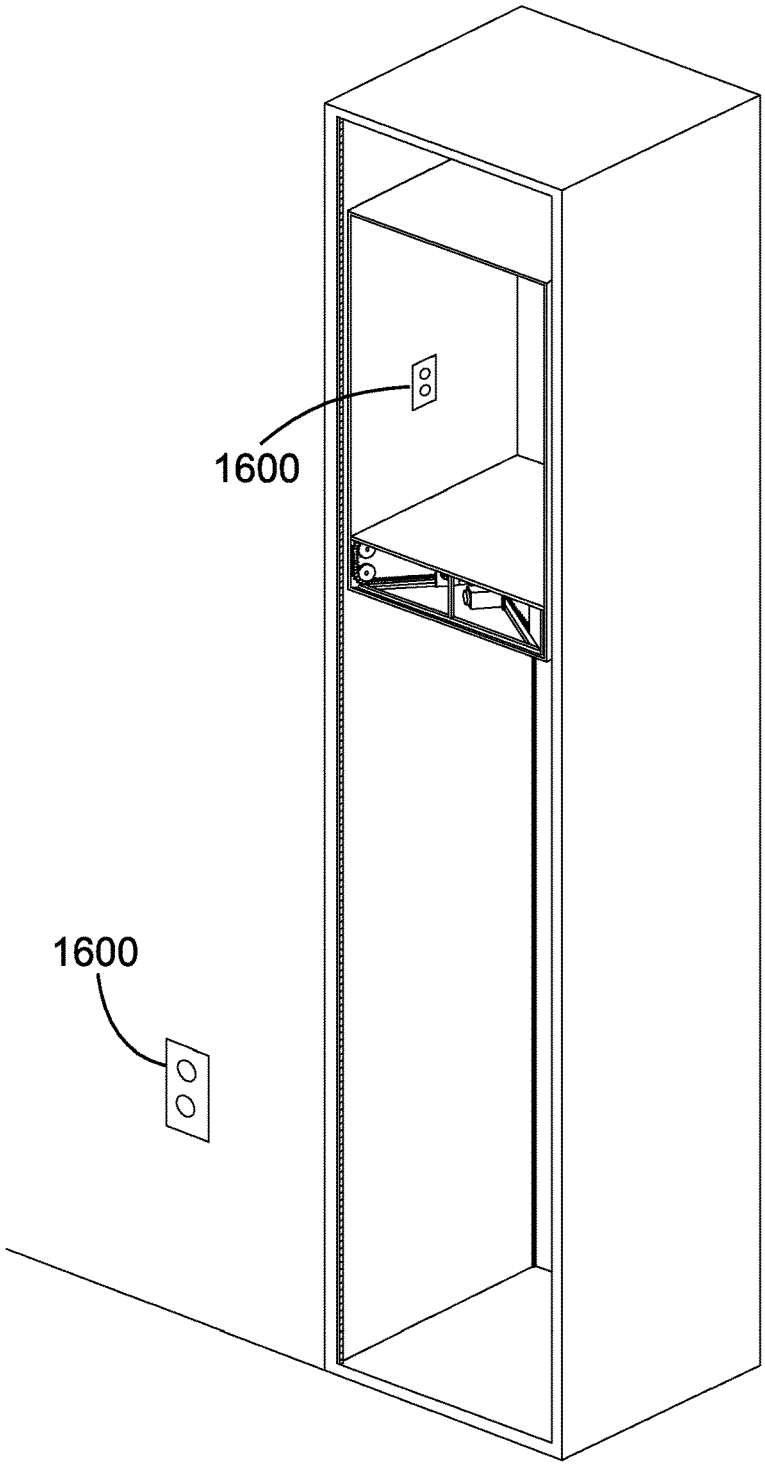
FIG. 16 depicts a perspective view of an elevator of the invention with a control system.

In one embodiment, the elevator comprises a control system. FIG. 16 depicts an elevator of the invention with a control system. In one embodiment, the control system comprises elevator buttons 1600. When a button is pushed, a command is sent to a computer system that controls the motor of the at least one rack and chain lifting device. In another embodiment, the control system comprises a voice control system.

Figure 17:
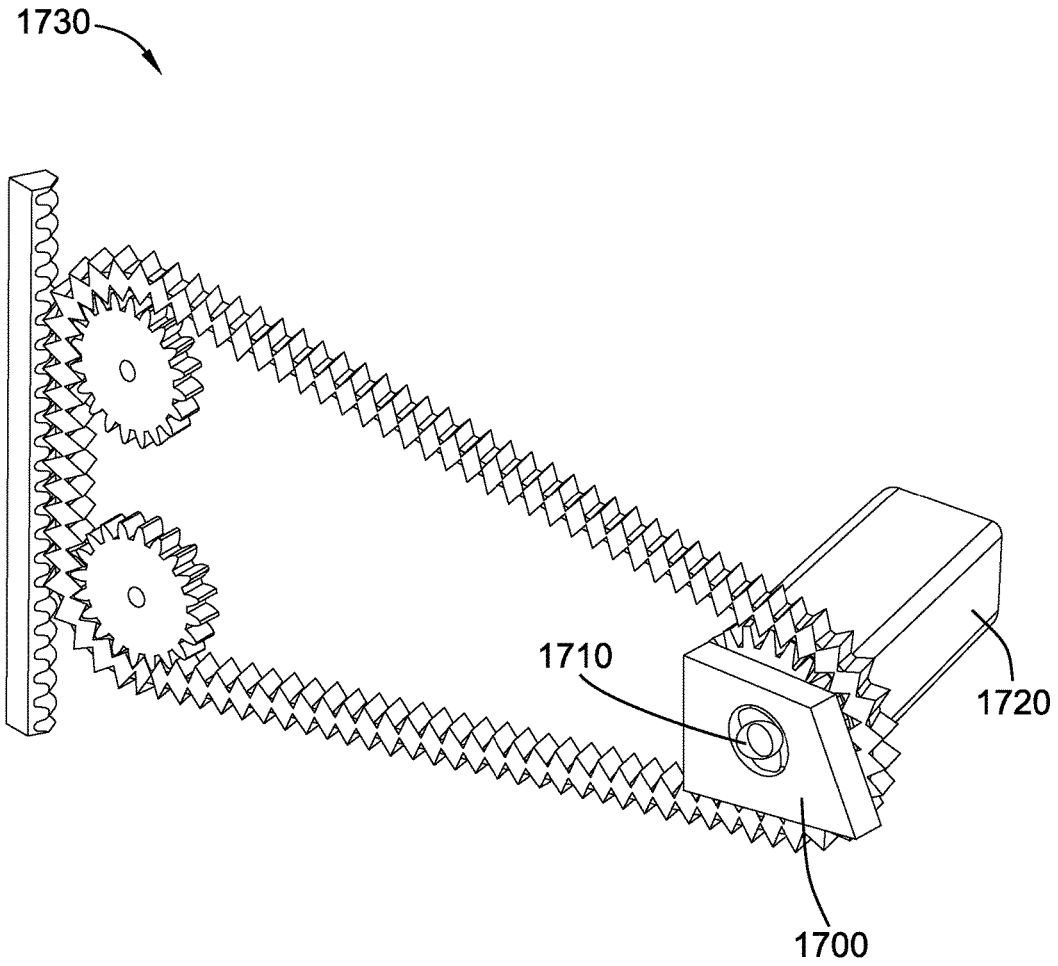
FIG. 17 depicts a perspective view of one embodiment of the braking system of the elevator.

In one embodiment, the elevator comprises a braking system. FIG. 17 depicts one embodiment of the braking system of the elevator. In one embodiment, brakes 1700 are secured on the end of a shaft 1710 that extends from the motor 1720 of the at least one rack and chain lifting device 1730. In one embodiment, the brakes 1700 are centrifugal brakes. If the motor shaft 1710 begins to rotate too fast, the brakes 1700 slow and eventually stop the elevator.

Figure 18:
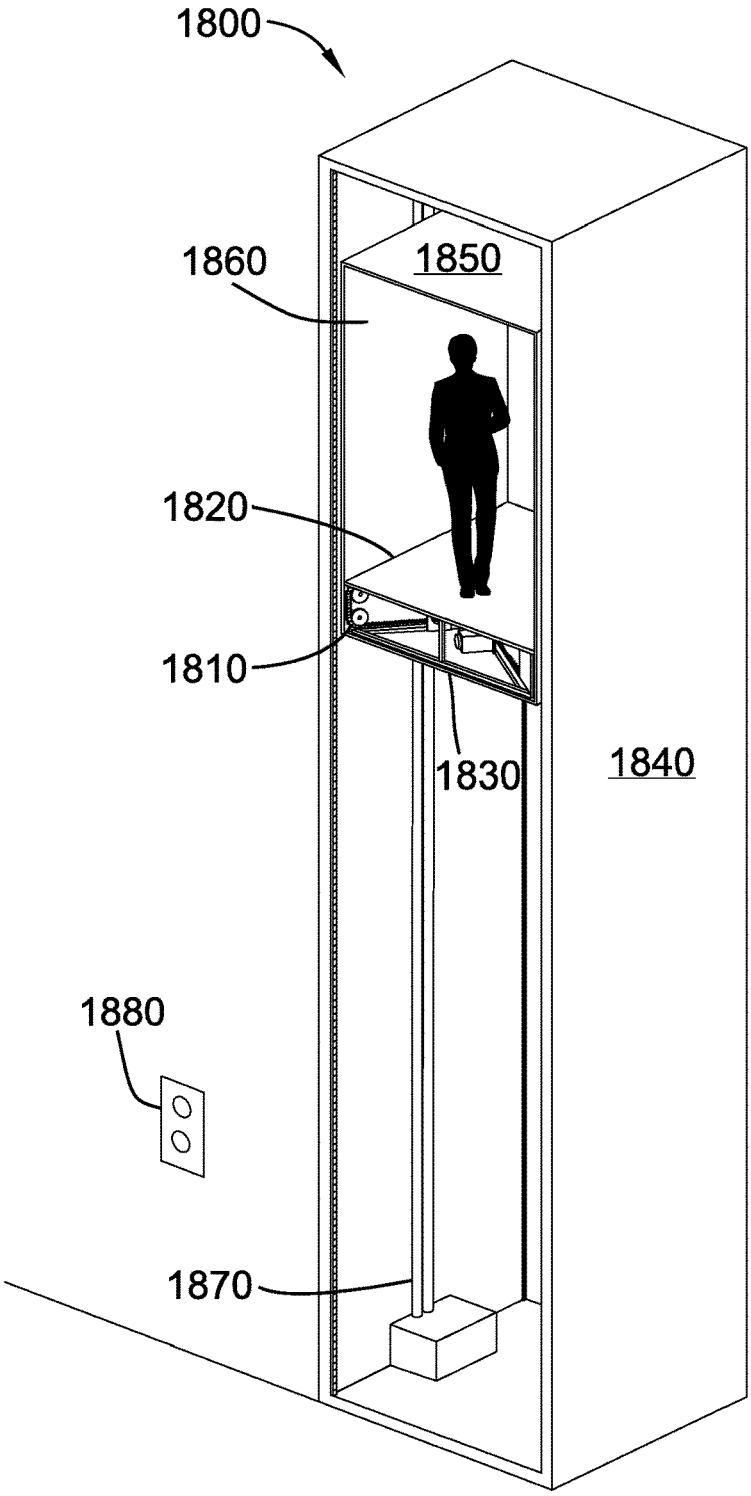
FIG. 18 depicts a perspective view of one embodiment of an elevator built in accordance with the invention engaged in lifting.

FIG. 18 depicts one embodiment of an elevator 1800 built in accordance with the invention engaged in lifting. The elevator comprises at least one rack and chain lifting device 1810. In one embodiment, the elevator 1800 further comprises a floor 1820, a transportable frame 1830, an elevator shaft 1840, an elevator box façade 1850, at least one fabric door 1860, a power supply system 1870, a control system 1880, and a braking system, not shown.

The invention claimed is:

1. An elevator comprising:

an elevator shaft, the elevator shaft comprising a corner rack mounted in each corner of the elevator shaft;

a transportable frame comprising a floor, the transportable frame further comprising a lifting device mounted in each corner of the transportable frame beneath the floor, each lifting device comprising at least one silent chain, at least three sprockets connected to the at least one silent chain, and a motor connected to one of the sprockets;

each corner rack comprising a profile of the at least one silent chain and the at least one silent chain comprising a profile of each corner rack, and wherein the at least one silent chain movably engages each corner rack to move the transportable frame up and down within the elevator shaft.

2. The elevator of claim 1, wherein the silent chain comprises a plurality of connecting pins and a plurality of link plates, the link plates stacked in alternating rows and bendably joined together by inserting the connecting pins through pin holes in the link plates, and the link plates having teeth that are shaped in such a way that the teeth of the alternating rows of link plates are offset when the silent chain is straightened, such that a profile of the silent chain corresponds with a profile of a rack.

3. The elevator of claim 1, wherein the corner rack has a truncated cubic configuration, and parallel to a front face, which comprises teeth, a point where two back faces join at an angle formed by a corner in which the corner rack is mounted.

4. The elevator of claim 1, wherein the at least three sprockets of each lifting device have profiles that correspond to the profile of the at least one silent chain.

5. The elevator of claim 1, wherein the motor drives the at least one silent chain around the at least three sprockets.

6. The elevator of claim 1, comprising four lifting devices.

7. The elevator of claim 6, wherein each of the four lifting devices is mounted in a corner.

8. The elevator of claim 1, wherein the transportable frame comprises a plurality of modular triangular prismatic components.

9. The elevator of claim 1, wherein a space between walls of the transportable frame and walls of the elevator shaft measures approximately one-sixteenth of an inch.

10. The elevator of claim 1, wherein length and width measurements of the elevator shaft are approximately four feet and one and one-half inch (1.295400 meters).

11. The elevator of claim 1, further comprising an elevator box façade.

12. The elevator of claim 1, further comprising at least one fabric door.

13. The elevator of claim 12, wherein the at least one fabric door comprises a plurality of adjacent doors.

14. The elevator of claim 13, wherein the at least one fabric door further comprises a light curtain.

15. The elevator of claim 1, further comprising a power supply system.

16. The elevator of claim 15, the power supply system comprising battery power.

17. The elevator of claim 1, further comprising a control system.

18. The elevator of claim 1, further comprising a braking system.

19. The elevator of claim 18, wherein the braking system comprises centrifugal brakes.

* * * * *